US005904262A

United States Patent [19]

Coppi

[11] Patent Number: 5,904,262

[45] Date of Patent: May 18, 1999

[54] FOLDING CONTAINER

[75] Inventor: Paolo Coppi, Fabriano, Italy

[73] Assignee: European Aviation Products S.R.L., Monsano, Italy

[21] Appl. No.: 08/848,604

[22] Filed: Apr. 29, 1997

[30] Foreign Application Priority Data

Sep. 27, 1996 [IT] Italy ..... MC960036 U

[51] Int. Cl.[6] ..... B65D 6/18

[52] U.S. Cl. ..... 220/7; 220/666; 220/4.29

[58] Field of Search ..... 220/7, 6, 4.29, 220/4.28, 666, 1.5, 4.34, 9.2, 9.3, 62

[56] References Cited

U.S. PATENT DOCUMENTS

| | | | |
|---|---|---|---|
| 1,673,769 | 6/1928 | Graham | 220/6 |
| 2,803,084 | 8/1957 | Frerking | 220/6 |
| 3,527,339 | 9/1970 | Cipolla | 220/6 |
| 4,913,302 | 4/1990 | Stonier | 220/6 |
| 5,064,068 | 11/1991 | Sheng | 220/6 |
| 5,251,772 | 10/1993 | Toguchi | 220/6 |

FOREIGN PATENT DOCUMENTS

| | | | |
|---|---|---|---|
| 2214903 | 9/1989 | United Kingdom | 220/7 |

*Primary Examiner*—Stephen J. Castellano
*Attorney, Agent, or Firm*—Beveridge, DeGrandi, Weilacher & Young, L.L.P.

[57] ABSTRACT

This patent application concerns a parallelepiped folding container having two horizontal walls capable of being folded towards the interior of said container so that the two walls can be then brought one against the other.

6 Claims, 9 Drawing Sheets

FOLDING CONTAINER

This patent application concerns a folding container used in its preferred embodiment for the transport of clothing items. Today, large lots of clothing items shipped by air, train or truck are packaged in large parallelepiped cardboard boxes often provided with a horizontal rod at the top on which the clothes hanger are hung.

These boxes are often placed on wooden pallets for handling purposes by means of mechanical fork lifts. These boxes are not however very practical in that they are fairly fragile.

During handling they may easily be squashed or ripped; the sides of the boxes can also easily be damaged—to the detriment of the clothing items contained in the same—when they are exposed to weather, above all rain.

The fact that they are so fragile often means that they can only be used once; in other words to all effects and purposes the boxes are not reusable.

In order to make these cartons sturdier, they were subsequently provided with an internal stiffening frame; the designers of said frame intended that at least this would be recyclable in that once the box was emptied it would be returned to the sender to be used inside another identical box. After some experience with these frames it appeared that the operators removing the goods from the boxes rarely dismounted and recovered the stiffening frames entirely so that often these were returned to the sender incomplete and therefore practically unusable.

An additional practical limitation of these cartons used for packaging clothing items—regardless of whether the same are provided with internal stiffening frame or otherwise—is that the same are very easy to open or tamper with, even in the case of theft.

It often occurred in fact that these boxes were tampered with in warehouses or even on the actual transport means, with the result that the goods contained in the same were stolen.

The folding container according to the invention is expressly designed to resolve all the problems of these previous containers.

The folding container in question consists of a supporting parallelepiped structure whose walls are padded with thin but sturdy sheet plate making the container resistant to weather, attempted theft, accidental jolting or compression.

A further practical and economic advantage of the folding container according to the invention, related to its sturdiness, is the fact that the same may be reused repeatedly; moreover, in order to facilitate its return to the sender, the folding container according to the invention, may be folded down completed when empty to the shape of a practical square or rectangular panel.

Finally, it should be mentioned that under the bottom padding wall there are a number of perimeter supporting feet which keep said bottom wall at a certain height from the ground making it possible to lift the item directly by means of a mechanical fork lift without the use of wooden pallets.

Even if the container in question is designed expressly for the transport of clothing items, it may obviously be used just as efficiently to transport other articles, in view of the perfect planarity of its internal walls.

For major clarity the description of the invention continues with reference to the enclosed drawings which are intended for purposes of illustration and not in a limiting sense whereby:

FIGS. 10 and 11 are two cross-sections of a special stopping device used in the second embodiment of the container in question.

Figure 1:
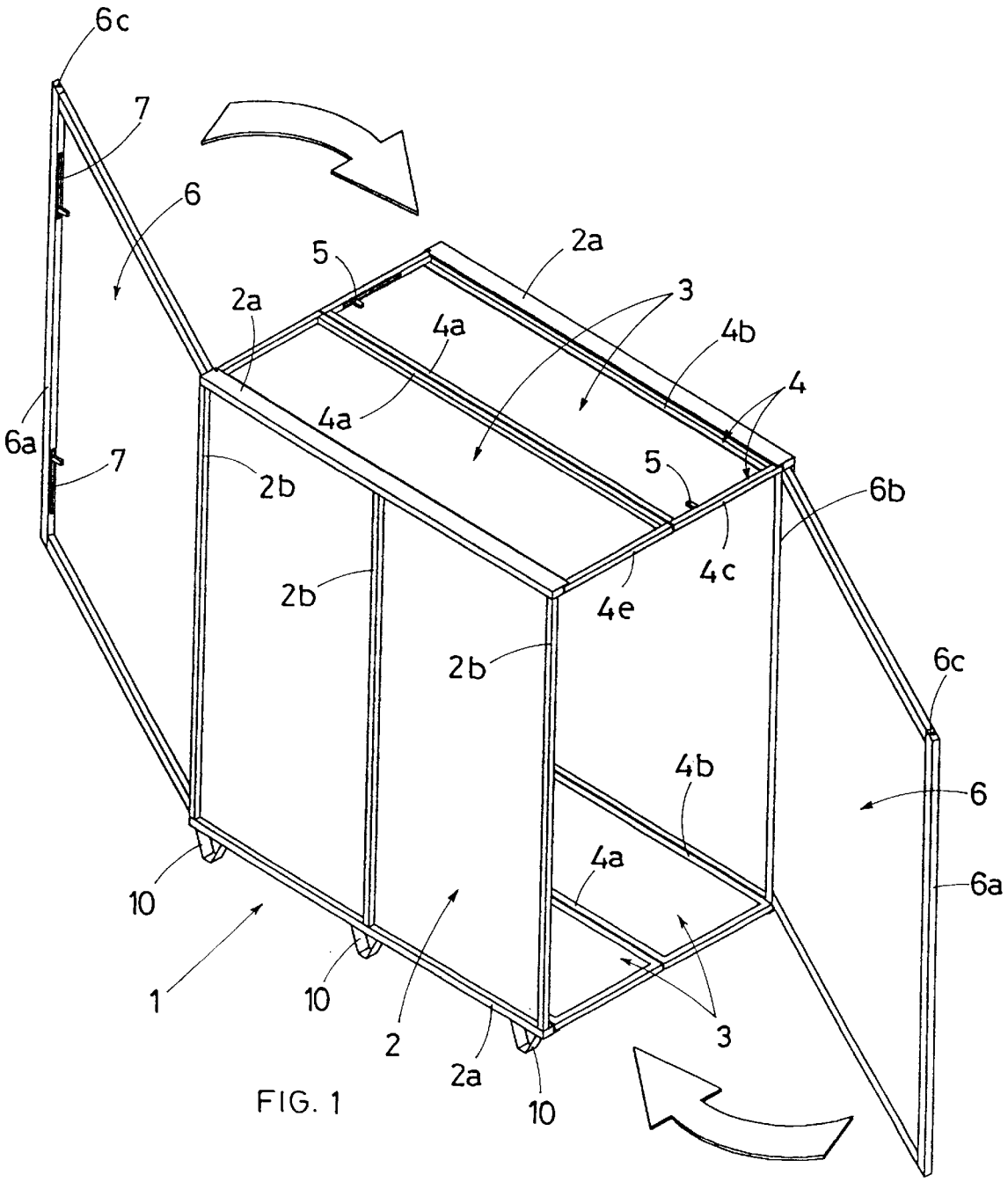
FIG. 1 is an axonometric view of the container in question with the lids open.
Figure 2:
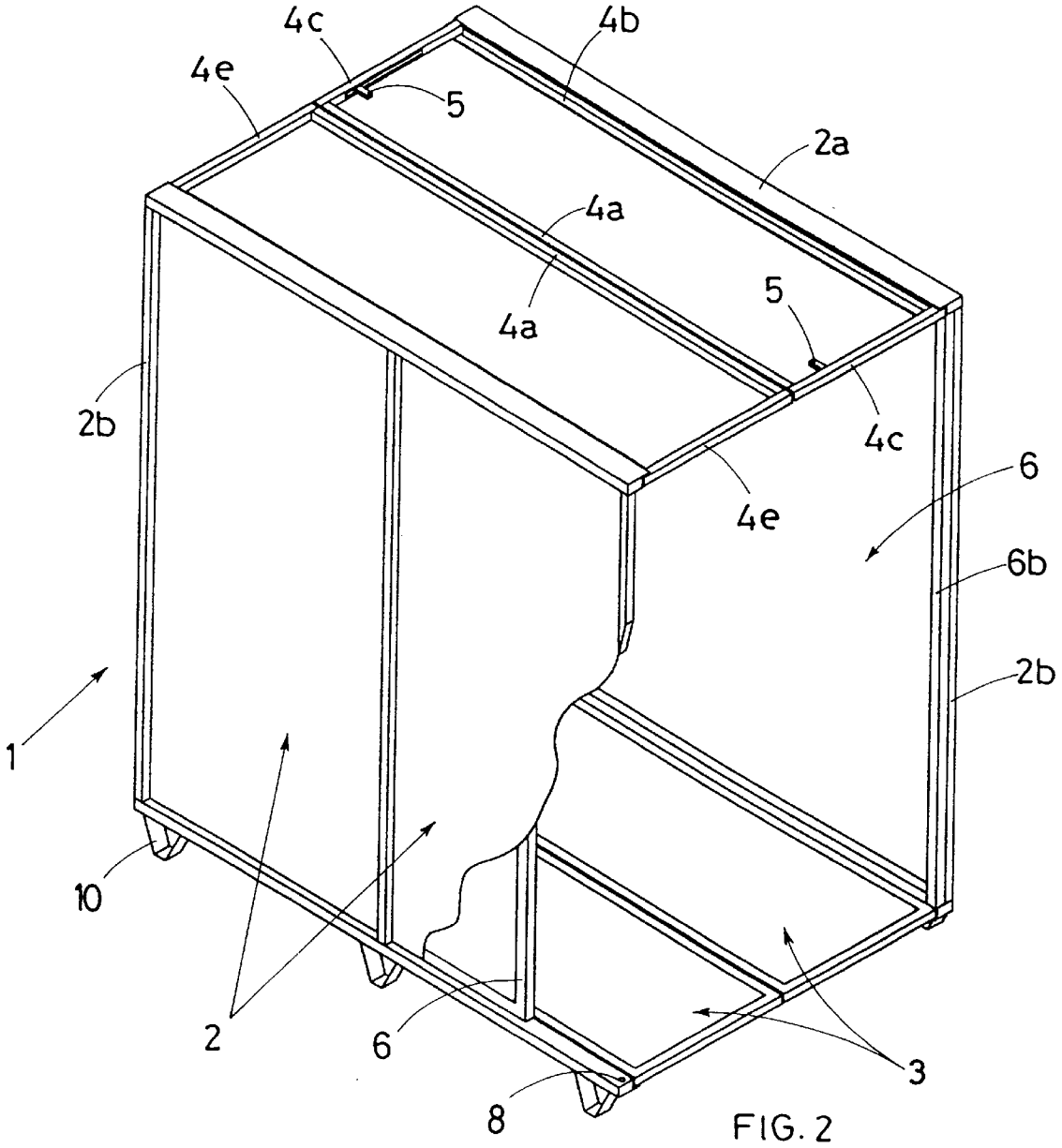
FIG. 2 is similar to FIG. 1 but with the lids shut against the internal surface of the sides of the container.

With particular references to FIGS. 1 and 2, the folding container (1) in question consists in its simplest embodiment of a frame padded with sheet plate panels.

The same has a parallelepiped shape provided with two opposing supporting sides (2) each consisting of two cross-members with "L" shaped transverse cross-section (2*a*) and by three uprights (2*b*).

The top and the base of said opposing sides (2) are provided with two special horizontal sealing walls (3) each consisting of two identical rectangular frames (4) hinged reciprocally to the relevant internal rods (4*a*).

The external rod (4*b*) of each of the two rectangular adjacent frames (4) is hinged to the horizontal wing of the "L" shaped cross member (2*a*) of the relevant side (2).

When the container (1) in question is in operating position, the two frames (4) making up each horizontal wall (3), must remain in horizontal and coplanar position; for this purpose, in the opposing cross members (4*c*) of one of the frames (4) there are respective bolts (5) whose pointed ends project from relevant holes (4*d*) realised at the end of said cross members (4*c*) and penetrate the tubular cross members (4*e*) of the adjacent supporting frame (4) through the holes (4*f*).

Figure 5:
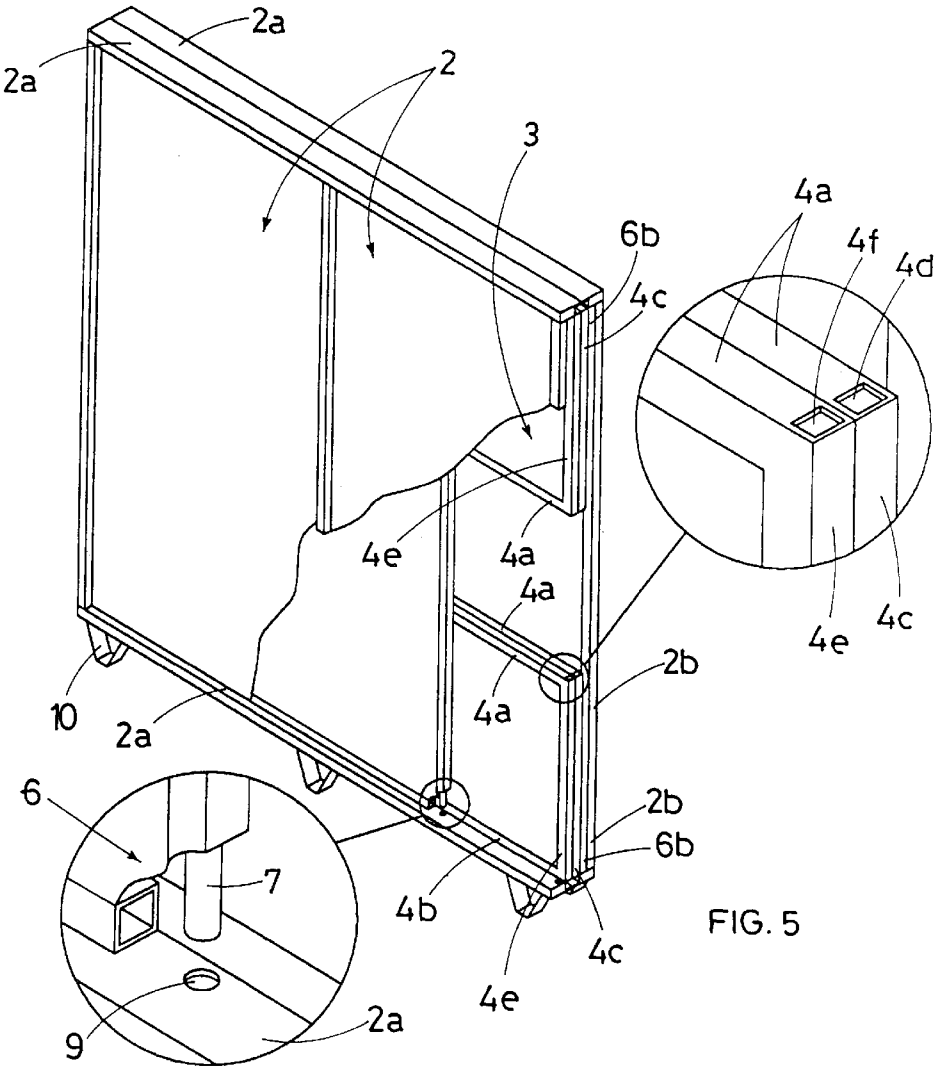
FIG. 5 is similar to the previous figure but with a section of one of the sides removed to show some of the details which are even more evident in the relevant blow-ups.

The particular structure of said cross members (4*c* and 4*e*) is illustrated clearly in the blow up in FIG. 5.

It is evident that the two bolts (5) are designed to provide continuity to the two pairs of tubular cross members (4*c* and 4*e*).

The openings of the container (1) in question are shut by means of two opposing and counter-rotating lids (6) each of which is hinged by means of pins having a vertical axis, between the horizontal wings of the cross members (2*a*) of each side (2).

Each of said lids (6) may be rotated so that it completely shuts the relevant opening of the container in question (1); when the same is in operating position, each lid (6) must naturally be fixed into closing position.

For this purpose, each lid (6) is provided on the upright (6*a*) opposite to the upright (6*b*) hinged to the side (2*a*), with two bolts having vertical axis (7) which slide inside the upright (6*a*).

The pointed ends of the two bolts (7) may be pushed out of the tubular upright (6*a*) housing the same through two holes (6*c*) with which the same is provided at the two ends.

When the lid (6) is shut, the pointed ends of said bolts (7) penetrate the relevant opposing holes having vertical axis (8)

realised on the internal surface of the horizontal wing of the bottom and top cross members (2*a*) of each side (2).

When the container (1) in question is compacted, it is necessary firstly to remove from the relevant housing holes (8) the bolts (7) provided on the two lids (6).

Once said lids (6) are released, the same may rotate towards the interior of the container (1) until their internal face touches the internal face of the side (2) on which the same are hinged.

For this purpose, it is evident that the width of said lids (6) must be inferior to the length of the sides (2), otherwise the same could not be fully housed in the container.

In order to lock said lids (6) into this position, the internal face of the horizontal wing of the cross members (2*a*) of the sides (2) is provided with opposing pairs of holes having vertical axis (9) in which the pointed ends of the bolts (7) on the lids (6) house, when the same touch the internal face of the relevant side (2); see the blow up in FIG. 5.

The second operation required to reduce the dimensions of the container in question (1) consists of uncoupling the two halves of the two horizontal closing walls (3); for this purpose it is sufficient to pull back the two bolts (5) housed in one of the two frames (4) so that their pointed ends come out of the cross member (4*e*) of the adjacent frame.

This operation interrupts the continuity between the two frames (4) making up each closing wall (3).

Figure 3:
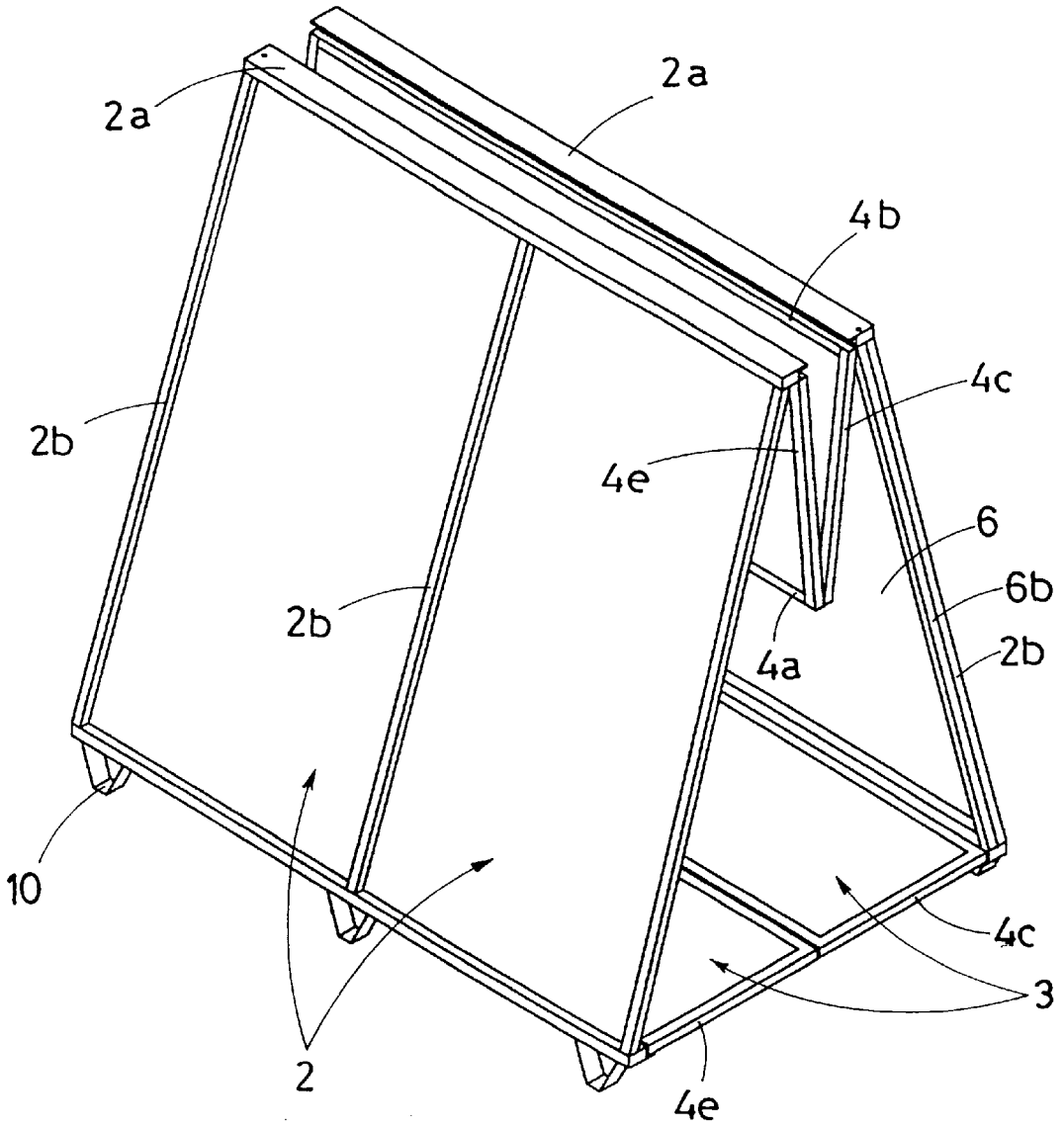
FIG. 3 is an axonometric view of the container in question with the top horizontal wall during the closing stage.

This permits folding the two halves of each wall (3) against each other, towards the interior of the container (1), by means of the three hinges: one being in an intermediate position between the two frames (4) and the other two being between the external rod (4*b*) of each of the frames (4) and the relevant cross member (2*a*) of the side (2); see FIG. 3.

Figure 4:
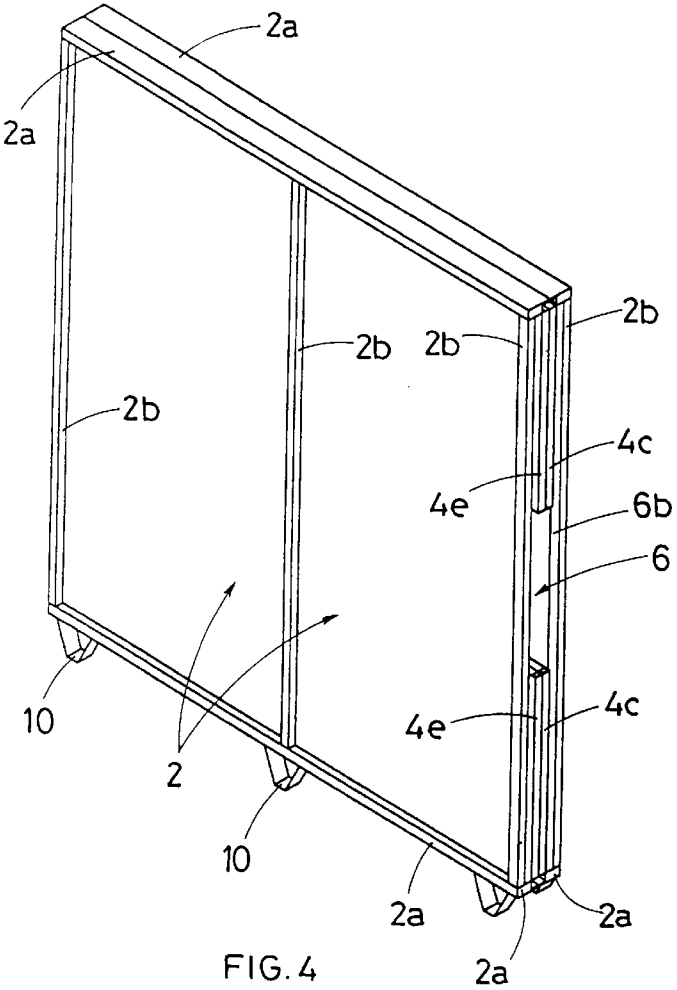
FIG. 4 is an axonometric view of the container, completely folded down.

It is evident that once both the horizontal walls (3) have been folded, the container in question (1) assumes the shape of a panel having a rectangular surface, which is very easy and inexpensive to transport, as shown in FIGS. 4 and 5.

In the enclosed drawings, the number (10) illustrates the special feet, positioned edgewise, provided under the bottom wall of the container according to the invention.

With reference to FIGS. 6–11, the second embodiment of the container (100) is characterised in that its lids (60) are hinged to a frame (11), which is in turn hinged between the horizontal wings of the cross member (2*a*) of each side (2).

Said frame (11) is designed to make the container in question sturdier, especially when the lids (60) are open.

Figure 6:
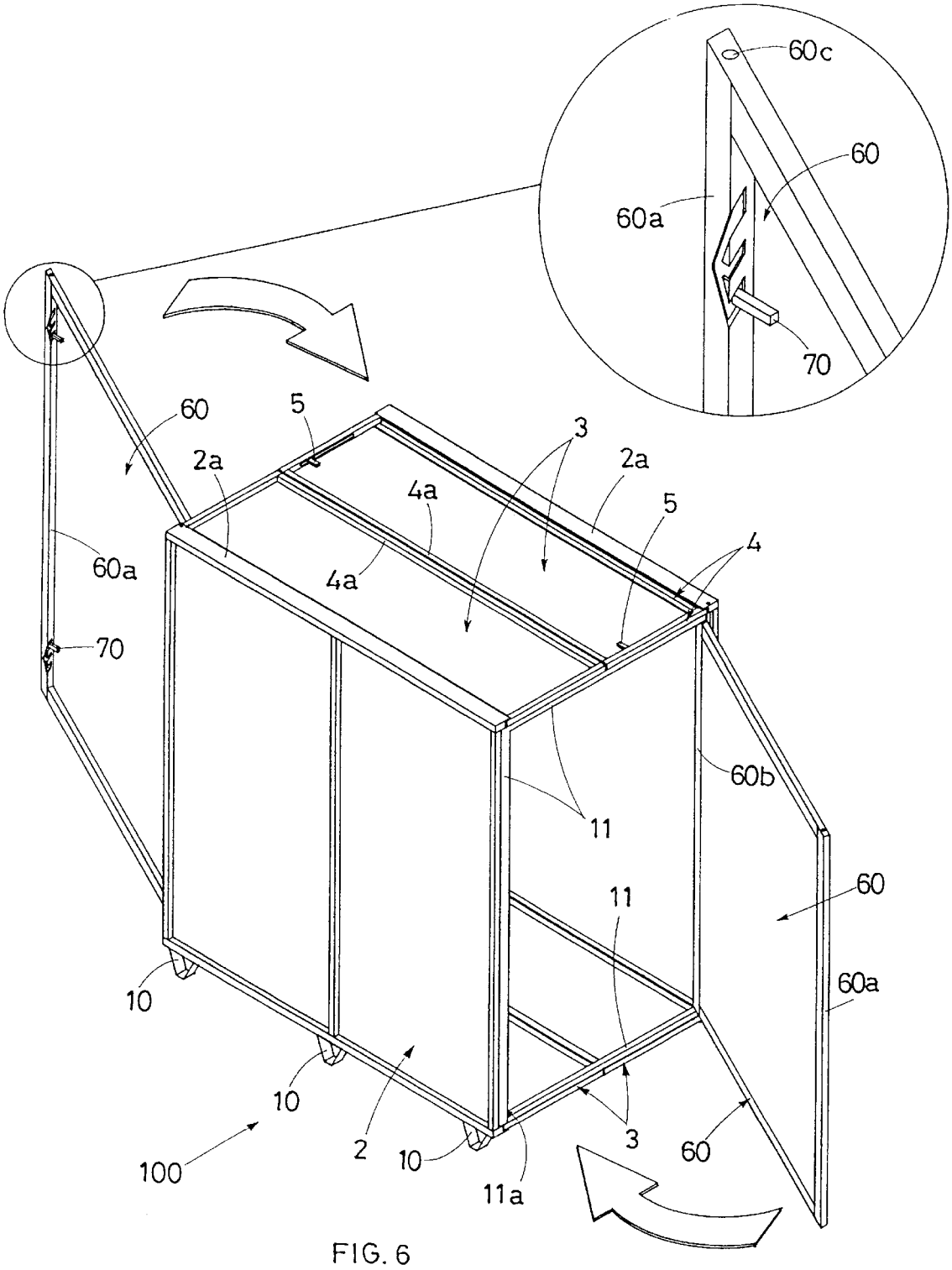
FIGS. 6–11 are substantially similar to the previous ones but refer to an alternative embodiment of the container in question, which differs from the first only by the provision of a pivoting frame for the doors designed to make the container in question sturdier, especially when the lids are open.
Figure 7:
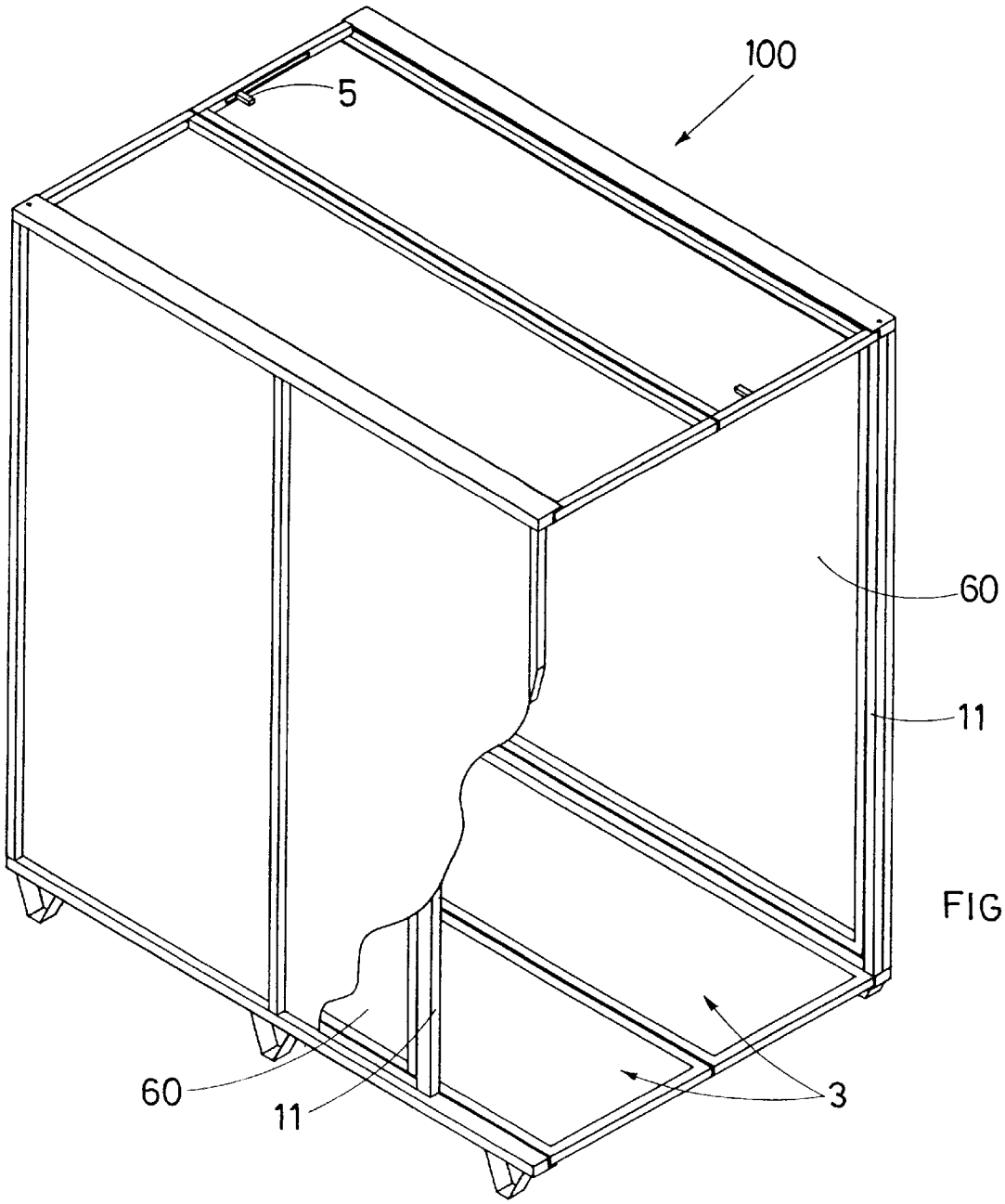

As shown in FIG. 6, when the lids (60) are open, said frame (11) is positioned between the opposing sides (2) and the horizontal closing walls (3) whose frames (4) are supported in aligned and coplanar position by the frame (11) by means of which the same supports the stress, as in the previous version, which the bolts (5) sustain.

This second version of the container in question is particularly suitable for transporting very heavy items, which require a sturdy and rigid supporting frame.

As shown in the blow up in FIG. 6, each lid (60) is provided on its upright (60*a*), opposite to that (60*b*) hinged to the frame (11), with two bolts having vertical axis (70) which slide within the upright (60*a*).

The pointed ends of the two bolts (70) may be pushed out of the upright (60*a*) through the two holes (60*c*) provided at its ends.

Said bolts (70) in fact perform two different expulsion strokes: a short stroke and a long stroke.

In the case of the short expulsion stroke, the tip of the bolt (70) penetrates into the corresponding holes (11*a*) provided on the bottom and top cross members of the frames (11); said expulsion stroke stops the lids (60) inside the frames (11) when the container (100) is in open and operating position.

In the case of the longer expulsion stroke, the tip of the bolts (70)—after crossing the above holes (11*a*)—penetrates the holes (9) provided on the internal face of the horizontal wing of the cross members (2*a*) of the sides (2).

Figure 9:
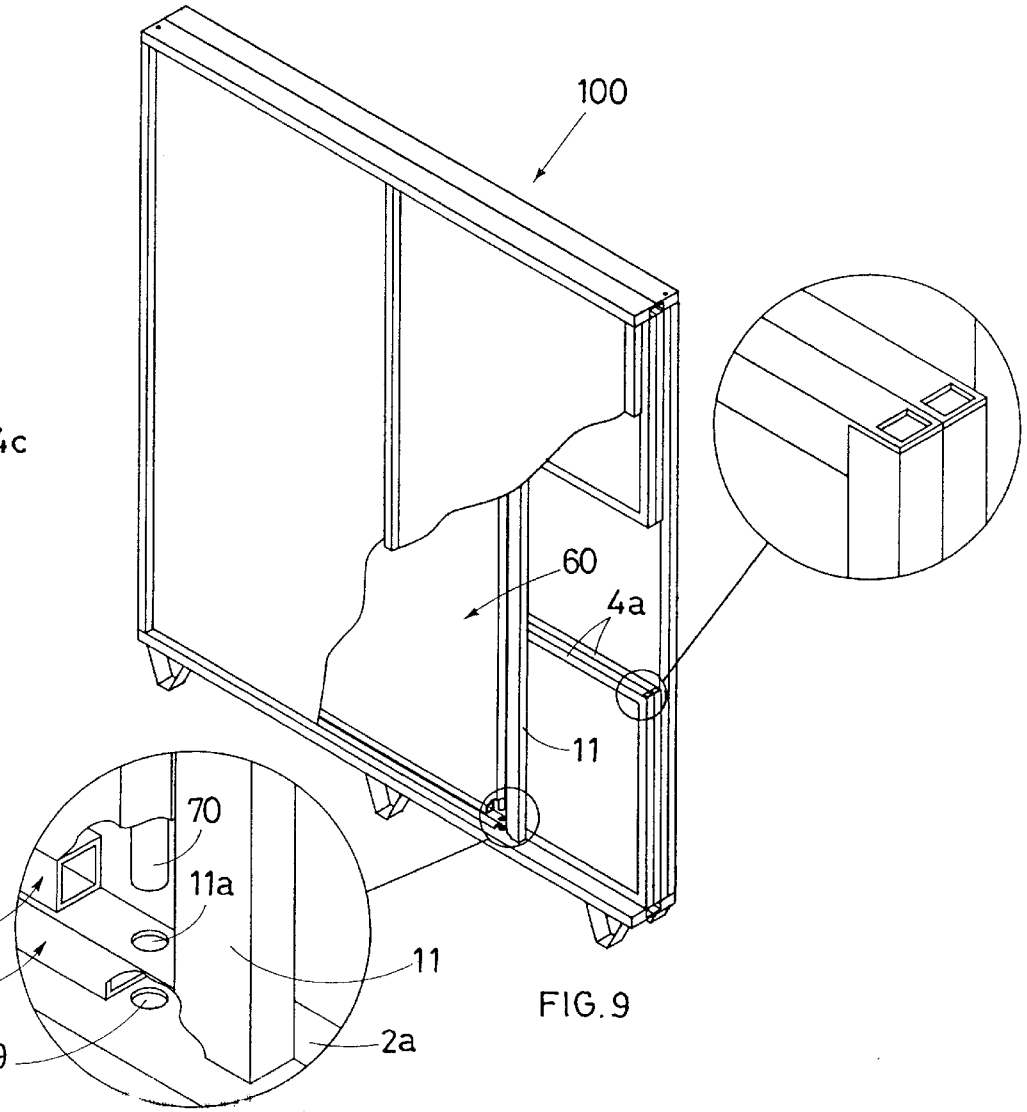
Figure 8:
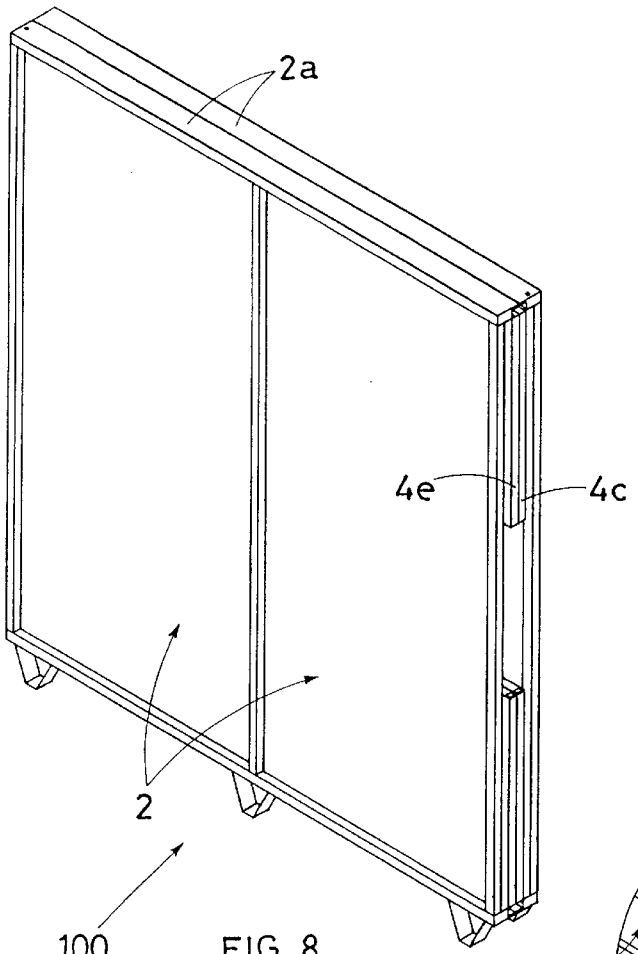

This longer expulsion stroke stops the lids (60) and the frames (11) at the same time against the internal face of the sides (2); as shown in FIG. 9, when the container (100) is fully folded down, the lids (60) and the frames (11) abut against the internal face of the sides (2).

Figure 11:
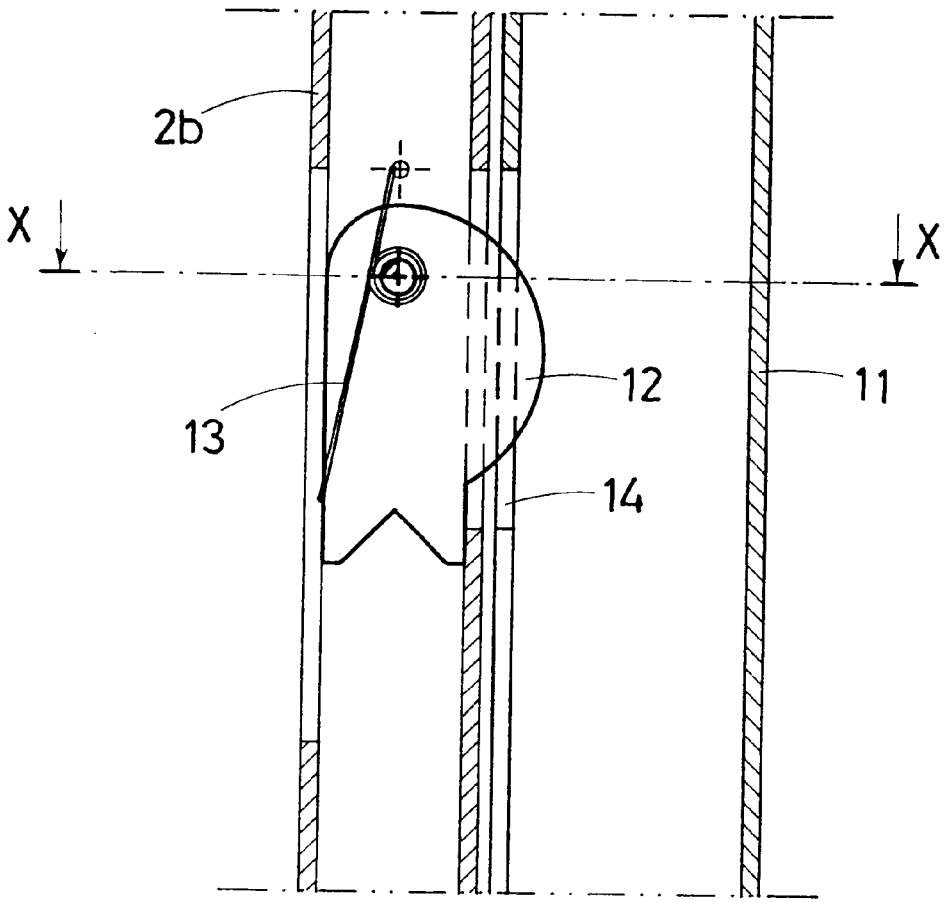
Figure 10:
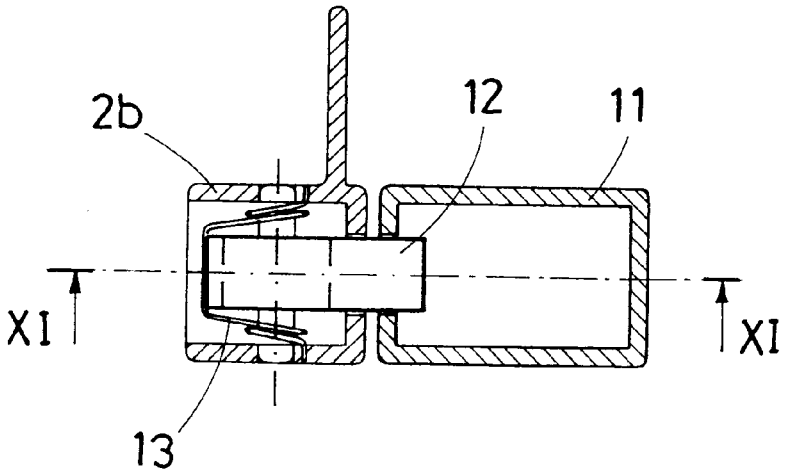

With reference to FIGS. 10 and 11, it should be noted that in order to stop each frame (11) in open position—namely in a position between the opposing sides (2) and the walls (3), as shown in FIG. 6—an oscillating tooth (12) is provided, which is embedded and pivoted within the upright (2*b*) against which the upright of the frame (11) touches; said tooth (12) can be held with a finger and pushed into its housing overcoming the antagonistic force of an expulsion spring (13).

The upright of the frame (11) being provided with a slot (14) into which the tooth (12) fixes.

Figure 12:
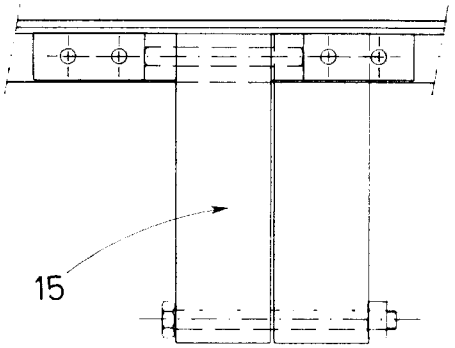
FIGS. 12, 13 and 14 are three orthogonal views of a special compass opening support foot used in the second embodiment of the container in question.
Figure 13:
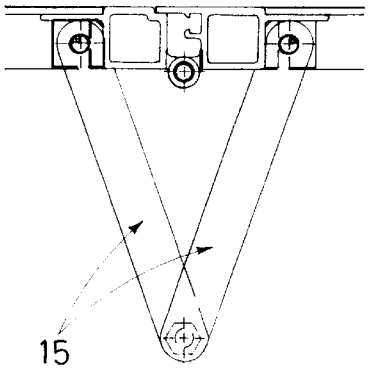
Figure 14:
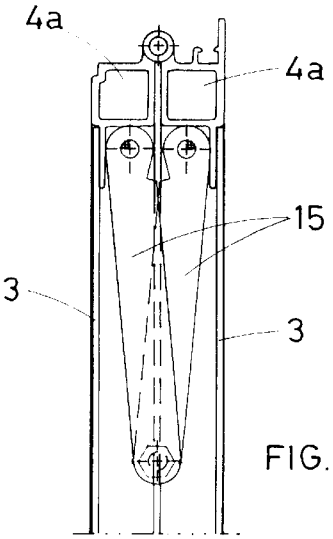

With reference to FIGS. 12, 13 and 14, attention is drawn to the fact that this container (100) is provided not only with external feet (10) but also with centre supporting feet (15) positioned on the hinging line between the two frames (4) which contribute to forming the bottom wall (3).

These centre feet (15) are provided in consideration of the fact that this version of the container is designed to transport particularly heavy items, and therefore can sustain heavy bending strain on the bottom wall (3).

Each of these feet (15) is characterised by a compass structure whose arms are pivoted under the internal rods (4*a*) of the frames (4) so that each foot (15) may close like a compass and remain embedded between the frames (4) when the same are rotated and touch against each other as the container (100) is folded, as shown in FIG. 14.

I claim:

1. A folding container characterised by a supporting parallelepiped frame padded with sheet plate panels, consisting of:

two opposing sides (2) each consisting of two cross members having "L" shaped cross-section (2*a*) and two uprights (2*b*); the internal face of the horizontal wing of each of said cross members (2*a*) being provided with three holes having vertical axis, two holes (8) at its ends and a third hole (9) positioned approximately at three-quarters of its length;

two horizontal closing walls (3), a bottom and a top wall, each consisting of a pair of identical frames (4) having rectangular plane; the external rod (4*a*) of each frame (4) being hinged to the horizontal wing of the "L" shaped cross member (2*a*) of one of the sides (2), while the internal rods (4*b*) of each adjacent pair of said frames (4) are hinged reciprocally; within the opposing cross members (4*c*) of one of the frames (4) of each adjacent pair of frames (4) relevant bolts (5) are housed whose pointed ends project from the holes (4*d*) provided at the end of the cross members (4*c*) to penetrate the tubular cross members (4*e*) of the adjacent frame (4) through the holes (4*f*) realised on said cross members (4*e*);

two opposing and counter-rotating lids (6 or 60), each of which housed, on its upright (6*a* or 60*a*) opposite to the hinging upright (6*b*), two bolts having vertical axis (7 or 70), whose pointed ends project through two holes (6*c* or 60*c*) provided at the end of the upright (6*a* or 60*a*).

2. A folding container according claim 1 characterised in that the lids (6) are hinged, by means of pins having vertical axis, between the horizontal wings of the cross members (2*a*) of each side (2).

3. A folding container according to claim 1 characterised in that the lids (60) are hinged to a frame (11), which is in turn hinged by means of pins having vertical axis between the horizontal wings of the cross members (2*a*) of each side (2); the top and bottom cross members of said frame (11) being provided with holes (11*a*) into which the tips of the bolts (70) realised on the lids (60) slide.

4. A folding container, according to claim 3, characterised in that the unhinged upright of the frame (11) is provided with a slot (14) in which an oscillating tooth (12) subject to the action of an expulsion spring (13) fixes and is pivoted in the upright (2*b*) against which the upright of the frame (11) touches.

5. A folding container according to claim 1 characterised by a series of perimeter feet (10) placed edgewise under the bottom horizontal wall.

6. A folding container according to claim 1 characterised by external feet (10) under the bottom horizontal wall as well as centre supporting feet (15) positioned along the hinging line between the two frames (4) which contribute to forming the bottom wall (3); each of said feet (15) being characterised by a compass structure whose arms are pivoted under the internal rods (4*a*) of the frames (4).

* * * * *

UNITED STATES PATENT AND TRADEMARK OFFICE

CERTIFICATE OF CORRECTION

PATENT NO. :5,904,262
DATED :May 18, 1999
INVENTOR(S) :Coppi

It is certified that error appears in the above-identified patent and that said Letters Patent is hereby corrected as shown below:

On the title page, item [73] delete "European Aviation Products S.R.L. Monsano, Italy" and insert --Penang Holding N.V., 1999 Caracashaaiweg, Curacao, Netherlands Antilles --

Signed and Sealed this

Twenty-fourth Day of October, 2000

*Attest:*

Q. TODD DICKINSON

*Attesting Officer*

*Director of Patents and Trademarks*